US005261348A

United States Patent [19]

Niehaus et al.

[11] Patent Number: 5,261,348

[45] Date of Patent: Nov. 16, 1993

[54] FLOW-THROUGH CELL WITH DIVERTER CIRCUIT

[75] Inventors: K. Lynn Niehaus, Manchester; David Mioduszewski, Ann Arbor, both of Mich.

[73] Assignee: QED Environmental Systems, Inc., Ann Arbor, Mich.

[21] Appl. No.: 941,694

[22] Filed: Sep. 8, 1992

[51] Int. Cl.[5] ..... E21B 49/08

[52] U.S. Cl. ..... 166/64; 166/68

[58] Field of Search ..... 166/64, 68, 105; 73/302, 864.34

[56] References Cited

U.S. PATENT DOCUMENTS 4,257,751 3/1981 Kofahl ..... 166/64 X
4,489,779 12/1984 Dickinson et al. ..... 166/64
4,585,060 4/1986 Bernardin et al. ..... 166/64
4,727,936 3/1988 Mioduszewski et al. ..... 417/394
4,903,765 2/1990 Zunkel ..... 166/64 X

*Primary Examiner*—Thuy M. Bui
*Attorney, Agent, or Firm*—Harness, Dickey & Pierce

[57] ABSTRACT

There is provided a flow-through cell with a diverter valve for continuously monitoring specific parameters of a fluid which passes through the flow-through cell. The diverter valve diverts a portion of fluid flow from a fluid line to the flow-through cell. The flow-through cell has an analyzing probe capable of monitoring a plurality of conditions of the fluid that is flow through the cell. By continuously monitoring specific parameters of the fluid as it moves through the flow-through cell, it is possible to constantly monitor the condition of the fluid and react to changes or stabilization of the readings provided by the probe.

21 Claims, 2 Drawing Sheets

FLOW-THROUGH CELL WITH DIVERTER CIRCUIT

FIELD OF THE INVENTION

The present invention relates to an apparatus for the analysis of a groundwater sample. More particularly, the present apparatus relates to a flow through cell for continuously analyzing the groundwater such that the user is provided with the opportunity of purging a minimum amount of water before a groundwater sample is accepted for analysis.

BACKGROUND OF THE INVENTION

Recent increases in public concern for the environment have resulted in various government imposed environmental regulations. Among such regulations are requirements relating to the monitoring of groundwater quality. In response to these requirements, water quality analytic capabilities have been improved and water sampling equipment has been developed. Much has not been effective, however, in obtaining consistent, non-contaminated water samples that are accurately representative of the water system from which the sample is taken.

Groundwater quality is monitored by drilling one or more groundwater monitoring wells in the area where it is necessary to periodically observe the quality of the groundwater. Preferably, a dedicated fluid sampling apparatus is positioned in each of the monitoring wells for obtaining an acceptable sample of the groundwater. A fluid sampling apparatus for use in conjunction with the present invention is disclosed in U.S. Pat. No. 4,489,779 issued Dec. 25, 1984 to Dickenson et al. and U.S. Pat. No. 4,585,060 issued Apr. 29, 1986 to Bernardin et al., the disclosures of which are hereby incorporated by reference.

Prior to obtaining an acceptable water sample from the monitoring well, the monitoring well must be purged approximately three to five times before a representative sample of the groundwater is available. In order to insure that a representative sample of the groundwater is available prior to accepting the sample, prior art sampling equipment operate in one of two ways. First, the equipment will simply purge the well an excessive number of times to insure a representative sample is available. This method proves to be unacceptable due to the excessive amount of water being purged, the excessive length of time involved in purging the well and the fact that it is never actually known if your sample is representative because it is assumed to be representative due to the excessive amount of purging.

The second method available to the prior art sampling equipment is to periodically test a sample until two or three samples have similar readings or until the readings have stabilized. While this method insure that a representative groundwater sample will be accepted, the process proves to be both time consuming and cumbersome.

Accordingly, what is needed is an apparatus which continuously monitors specified parameters of the groundwater as it is being pumped from the monitoring well. By continuously monitoring specified parameters of the groundwater being pumped, it is possible to obtain a representative sample in the shortest amount of time and with the minimum amount of groundwater having to be purged from the well. A groundwater sample is accepted once the specified parameters have stabilized.

SUMMARY OF THE INVENTION

The present invention discloses a flow-through cell which is equipped with at least one monitoring probe having at least one sensor. A portion or all of the groundwater is continuously diverted through the flow-through cell where specified parameters are continuously evaluated. Once these specified parameters are stabilized, a representative groundwater sample can be taken for further analysis.

BRIEF DESCRIPTION OF THE DRAWINGS

The above mentioned and other features and objectives of this invention and the manner of attaining them will become more apparent and the invention will be better understood by reference to the following description of the invention taken in conjunction with the accompanying drawings wherein.

DETAILED DESCRIPTION OF THE PREFERRED EMBODIMENT

Figure 1:
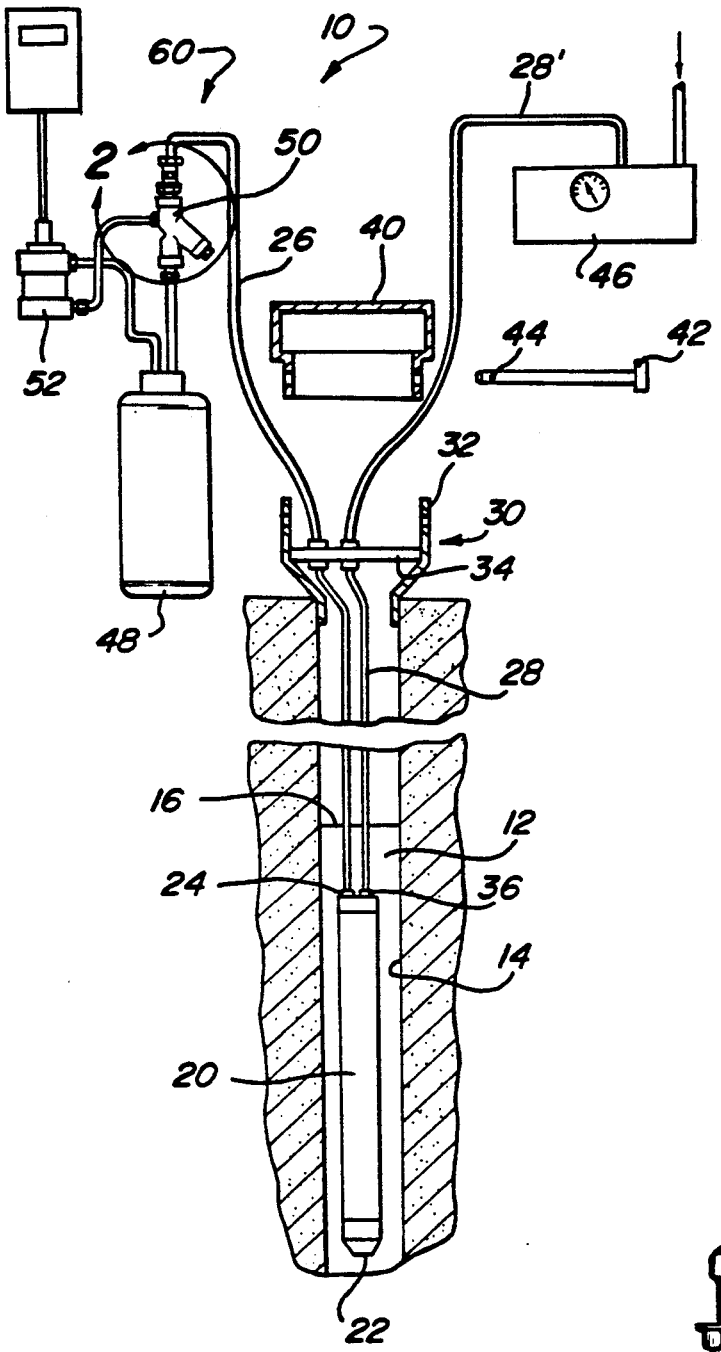
FIG. 1 is a partially exploded, longitudinal sectional view of a fluid sampling system which uses the flow-through cell with diverter circuit of the present invention.

For purposes of illustration, FIG. 1 of the drawings shows a flow-through cell with diverter circuit in accordance with the present invention installed in a monitoring well for withdrawing samples of groundwater using a bladder type of pump. One skilled in the art will readily recognize from the following discussion, the accompanying drawings and claims that the principles of the invention are equally applicable to fluid sampling apparatuses and pumps other than that shown in the drawings.

In FIG. 1, an exemplary fluid sampling apparatus incorporating the flow-through cell with diverter circuit of the present invention is indicated generally by reference numeral 10 and is shown for purposes of illustration as installed in a monitoring well 12, which preferably includes a well casing 14. A fluid sampling pump 20 is disposed within the well casing 14 of monitoring well 12 and is submerged beneath the water level of the groundwater 16 to a suitable depth for obtaining accurate and representative groundwater samples.

The preferred fluid sampling pump 20 is a fluid-actuated pump, wherein the actuating fluid is preferably a gas such as air, for example, and includes an inlet port 22 and an outlet port 24. A wellhead assembly 30 is secured to the well casing 14 and includes a wellhead body portion 32 having a generally horizontal support plate 34 therein. The body portion 32 substantially isolates the interior of the well 12 from the above ground surrounding environment in order to avoid or at least minimize contamination of the interior of the well which would result from the contact between the groundwater 16 and the air or other elements. The wellhead assembly 30 also includes a groundwater conduit 26 sealingly connected at one end to the pump outlet 24 and passing through plate 34 to provide direct sample delivery to a diverter valve 50. The diverter valve 50 is in turn connected to a purged water container 48 and a flow-through cell 52. The flow-through cell 52 is also connected to purged water container 48. A gas conduit 28 is connected at one end to a gas connection 36 on pump 20 and at the other end to support plate 34. Because the pump is preferably of a lightweight construction, the conduits may also be used to retain the pump in its submerged position in the well.

A controller apparatus 46, which is described in further detail in the disclosures of U.S. Pat. Nos. 4,489,779 and 4,585,060 is selectively and removably connected to the wellhead assembly 30 by means of external gas conduit 28'. The preferred controller apparatus 46 is a portable, lightweight unit and includes a source of an actuating gas and means for alternately positively pressurizing and venting or relieving the pressure of the actuating gas in order to operate the fluid sampling pump 20.

In order to further isolate the interior of the well 12 from above-ground contamination, the wellhead assembly 30 preferably includes a closure member 40 adapted to be secured to the body portion 32 by a locking pin 42 insertable through corresponding aligned apertures in body portion 32 and in closure member 40. The locking pin 42 preferably includes an aperture 44 at one end through which a padlock or other suitable locking means may be inserted in order to substantially prevent unauthorized access to the interior portions of the wellhead assembly.

Figure 2:
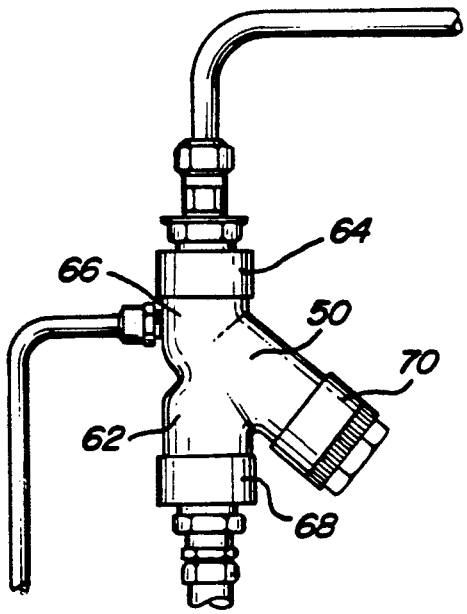
FIG. 2 is a side view of the diverter valve of the present invention.

The flow-through cell with diverter circuit 60 is comprised of two devices. The first is the diverter valve 50 and the second is the flow-through cell 52. The diverter valve 50 is shown in FIG. 2 and comprises a fluid body 62 having an inlet 64, two outlets 66 and 68 and a spring loaded poppet valve 70. The pump liquid discharge conduit 26 is connected to inlet 64 of diverter valve 50. Inlet 64 can be provided with a plurality of interchangeable connections to enable the diverter valve 50 to be connected to various sizes of discharge conduits 26. The first outlet 66 is connected by tubing to an inlet port 82 of flow-through cell 52. The second outlet 68 is connected by tubing to purged water container 48. In between inlet 64 and outlets 66 and 68 is the spring loaded poppet valve 70. When the pump 20 is activated, the groundwater will push against spring loaded popped valve 70 which will then open under a predetermined pressure. The opening of poppet valve 70 allows groundwater to flow from well 12 into purged water container 48 through outlet 68 and into flow-through cell 52 through outlet 66.

Diverter valve 50 is normally used in conjunction with pumps which have a relatively high flow rate of 3 to 10 gallons per minute. For pumps with lower flow rates, diverter valve 50 may be omitted and discharge conduit 26 would then go directly to input port 82.

Figure 3:
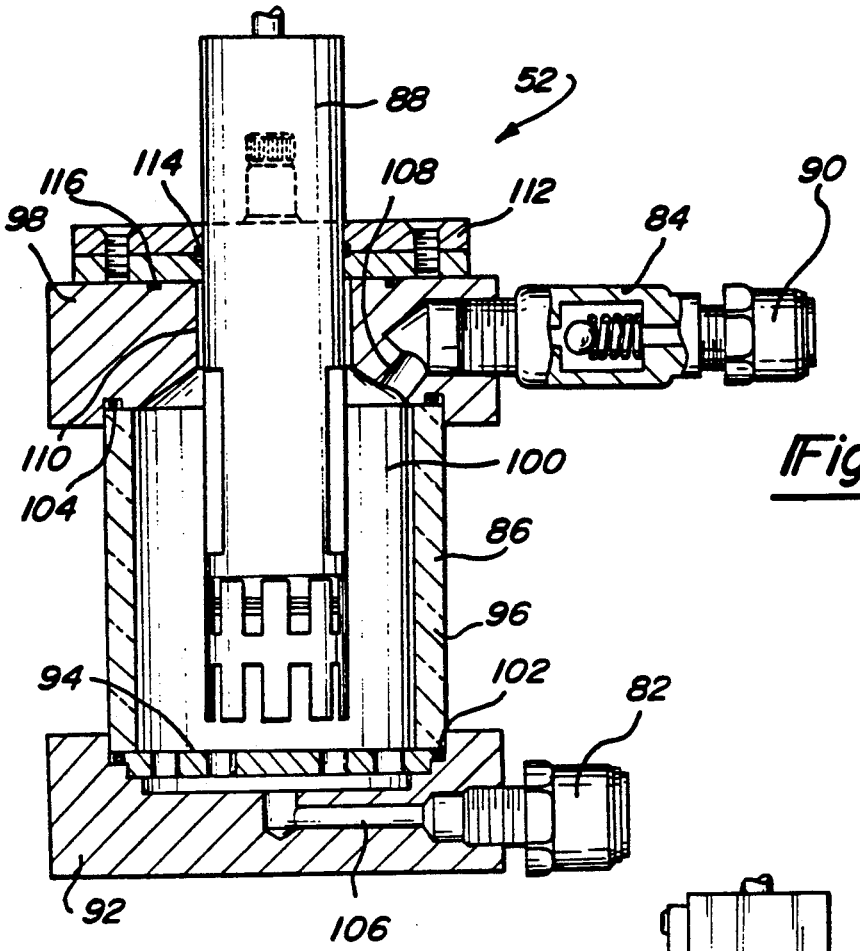
FIG. 3 is a side view partially in cross section of the flow-through cell of the present invention.
Figure 4:
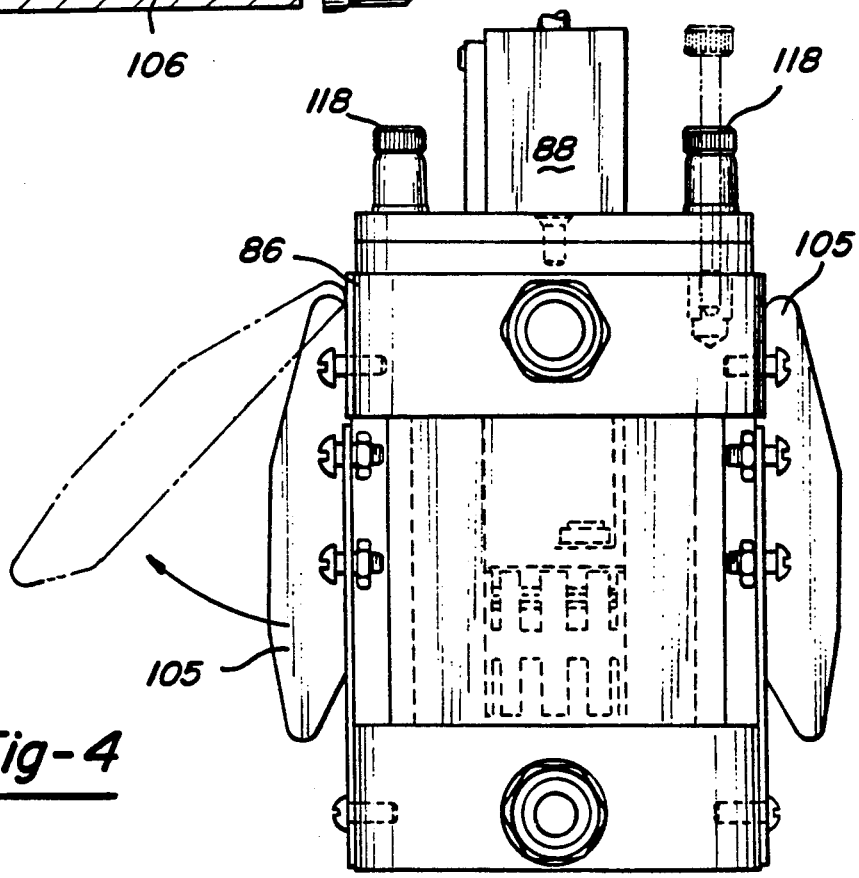
FIG. 4 is an additional side view of the flow-through cell of the present invention.

Flow-through cell 52 is shown in FIGS. 3 and 4. Flow-through cell 52 is comprised of an inlet port 82, a housing assembly 86, a probe 88, a check valve 84 and an outlet port 90. The inlet port 82 receives groundwater from outlet port 66 of diverter valve 50 via a tubing interconnecting the ports.

Housing assembly 86 is comprised of a lower housing 92, a diffuser plate 94, a clear sight cylinder 96 and an upper housing 98. Lower housing 92, clear sight cylinder 96 and upper housing 98 are assembled as shown in FIG. 3 to define sealed chamber 100. Chamber 100 is sealed by seal 102 between lower housing 92 and clear sight cylinder 96 and by seal 104 between clear sight cylinder 96 and upper housing 98. Housing assembly 86 is held together by a plurality of latches which are released by quick release levers 105 shown in FIG. 4. To disassemble the flow-through cell 52 for cleaning all that is required is to release levers 105 by moving them to the position shown in broken line in FIG. 4.

Lower housing 92 has an inlet passage 106 which receives groundwater inlet port 82 and directs it into sealed chamber 100. Diffuser plate 94 is positioned between the outlet of passage 106 and sealed chamber 100 to allow the water to enter chamber 100 gently and evenly. Diffuser plate 94 makes sure the water traveling through sealed chamber 100 is dispersed in all directions such that all the groundwater is moving through the cell. There are no stagnant places in sealed chamber 100 where the groundwater does not move. Upper housing 98 has an outlet passage 108 which connects sealed chamber 100 with check valve 84 and outlet port 90. Outlet port 90 is connected by tubing to purged water container 48. Check valve 84 serves two basic purposes. First, pump 20 can be provided with weep holes that allow water to drain from the discharge conduit 26 when the pump is not in use. The is particularly useful to prevent freezing of the water when the monitoring site is in an area of below freezing temperatures. Check valve 84 will keep the flow through cell 10 full and checks off air so that groundwater cannot run out of the cell and back into the well through the weep holes in pump 20 between pump cycles. Second, when the sampling operation is complete and flow through cell 10 has been disconnected from the monitoring well, there will be water left in cell 10. Check valve 84 keeps water from running out of cell 10 as cell 10 is being moved from monitoring well to monitoring well. This eliminates the need to remove the cell and drain it after each sampling.

Upper housing 98 is also adapted to receive probe 88. Probe 88 is a water analyzer having a plurality of sensors or electrodes to measure various parameters of the groundwater. These sensors or electrodes could include PH electrodes, reference potential electrodes, temperature sensors, oxygen reduction potential electrodes, ion selective electrodes, conductivity electrodes, oxygen electrodes, hydrocarbon sensors, carbon dioxide sensors or any combination of these. A typical probe including a data recorder to display the analyzed results is shown in U.S. Pat. No. 4,103,179 issued Apr. 7, 1992 to Thomas et al. the disclosure of which is hereby incorporated by reference.

Probe 88 extends through an aperture 110 in upper housing 98. A retention plate 112 positions and holds probe 88 within sealed chamber 100 in the proper position. Retention plate 110 has a seal 114 to seal between probe 88 and retention plate 110. Retention plate 110 also has a seal 116 between retention plate 110 and upper housing 98 to complete the sealing of sealed chamber 100. Retention plate 110 is secured to upper housing 98 by a plurality of quick release thumb screws 118.

The apparatus operates as follows. Groundwater conduit 26 is connected to diverter valve 50. Diverter valve 50 may be attached to well casing 14 by a hanger or other means known in the art. Outlet port 66 of diverter valve 50 will be connected by tubing to inlet port 82 of flow-through cell 52. Outlet port 68 of diverter valve 50 will by connected by tubing to purge water container 48. Outlet port 90 of flow-through cell 52 will be connected by tubing to purge water container 48. The apparatus is now ready for operation.

The next step is to supply actuating gas to pump 20 thus actuating pump 20 and causing groundwater to be pumped from well 12 through diverter valve 50 into container 48. This will allow some groundwater to enter flow-through cell 52 and be discharged through outlet port 90 into container 48. The data recorder is turned on and continuous readings are recorded. When the readings of the data recorder have stabilized at acceptable levels, pump 20 is turned off, groundwater conduit 26 is disconnected from diverter valve 50, pump 20 is again turned on and the representative water sample is taken. The operation of the sampling apparatus by this method insures that the amount of purged groundwater from well 12 will be kept to a minimum.

While the above detailed description describes the preferred embodiment of the present invention, it should be understood that the present invention is susceptible to modification, variation and alteration without deviating from the scope and fair meaning of the subjoined claims.

What is claimed is:

1. A groundwater sampling apparatus for withdrawing groundwater samples from a groundwater monitoring well, said apparatus having dedicatable inground components to prevent the apparatus from contaminating another well, a gas-actuated water sampling pump having a gas chamber for receiving a gas therein, an outlet and a controller selectively communicable with said sampling pump, said controller comprising:

a source of said gas under pressure;

valve means connected to said source of said gas and being actuable into a pressurizing mode to provide gas communication between said source of said gas and said gas chamber and actuable into a relief mode to provide gas communication between said gas chamber and a region having a pressure lower than that of said source;

pneumatic timing control means for selectively actuating said valve means into a pressurizing mode for a first predetermined time period and actuating said valve means into a relief mode for a second predetermined time period, thereby causing the pressure of said gas in said chamber to be alternately raised and lowered;

a diverter valve having an inlet, a first outlet and a second outlet, said inlet of said diverter valve connected to said outlet of said pump; and a flow-through cell having an inlet and an outlet, said inlet of said through-cell connected to said first outlet of said diverter valve, said flow-through cell further having means for analyzing said groundwater as said groundwater enters said inlet of said cell and leaves said cell through said outlet of said cell;

said controller system being portable so as to be selectively connectable to and disconnectable from said sampling pump in said monitoring well or to a correlative dedicated inground sampling pump in similar monitoring wells.

2. The groundwater sampling apparatus of claim 1 wherein said diverter valve has a poppet valve disposed between said inlet and said first and second outlets, said poppet valve operable under a predetermined fluid pressure to connect said inlet of said valve to said first and second outlets of said valve.

3. The groundwater sampling apparatus of claim 1 wherein said second outlet of said diverter valve is connected to a sample collection vessel.

4. The groundwater sampling apparatus of claim 1 wherein said outlet of said flow-through cell is connected to a sample collection vessel.

5. The groundwater sampling apparatus of claim 1 wherein said analyzing means comprises a water analyzer having a plurality of sensors for measuring a plurality of conditions of said groundwater.

6. A groundwater sampling apparatus for withdrawing groundwater samples from a groundwater monitoring well, said apparatus having dedicatable inground components to prevent the apparatus from contaminating other monitoring wells, said apparatus having a gas-actuated water sampling pump for the groundwater monitoring well, said water sampling pump having an outlet and a gas chamber for receiving a gas therein, a controller system for controlling pressurization of gas in said gas chamber, said water sampling pump being substantially installed in, dedicated to, said groundwater monitoring well, said controller system being portable and being selectively connectable to, and disconnectable from said water sampling pumps or to correlative dedicated inground sampling pumps in similar groundwater monitoring wells, said controller system including:

a source of said gas under pressure;

means for selectively operating said last mentioned means to cause the pressure of said gas in said chamber to be alternately raised and lowered;

a diverter valve having an inlet, a first outlet and a second outlet, said inlet of said diverter valve connected to said outlet of said pump; and a flow-through cell having an inlet and an outlet, said inlet of said through-cell connected to said first outlet of said diverter valve, said flow-through cell further having means for analyzing said groundwater as said groundwater enters said inlet of said cell and leaves said cell through said outlet of said cell;

7. The groundwater sampling apparatus of claim 6 wherein said diverter valve has a poppet valve disposed between said inlet and said first and second outlets, said poppet valve operable under a predetermined fluid pressure to connect said inlet of said valve to said first and second outlets of said valve.

8. The groundwater sampling apparatus of claim 6 wherein said second outlet of said diverter valve is connected to a sample collection vessel.

9. The groundwater sampling apparatus of claim 6 wherein said outlet of said flow-through cell is connected to a sample collection vessel.

10. The groundwater sampling apparatus of claim 6 wherein said analyzing means comprises a water analyzer having a plurality of sensors for measuring a plurality of conditions of said groundwater.

11. A groundwater sampling apparatus for withdrawing groundwater samples from a groundwater monitoring well, said apparatus having dedicatable inground components to prevent the apparatus from contaminating similar groundwater monitoring wells, said apparatus comprising:

a gas-actuated pump adapted to be submerged in the groundwater within said well for pumping a portion of said groundwater therefrom, said pump being substantially permanently installable in, and dedicatable to, said well and having a pump body portion including a gas chamber, a groundwater chamber having an inlet and an outlet, and a flexible bladder for isolating said gas chamber from said groundwater chamber, said groundwater chamber being in communication with said groundwater in said well through said inlet when said pump is submerged therein, substantial portions of said pump, including said pump body portion and said flexible bladder being composed of a polymeric material;

a wellhead assembly substantially permanently installable on, and dedicatable to said well and including a wellhead body portion adapted to be secured to said well to isolate the interior of said well from the above-ground surroundings, said wellhead assembly further including a gas conduit having one end sealingly connected to said gas chamber and an opposite end fixedly and sealingly connected to said wellhead body portion, a groundwater conduit having one end sealingly connected to said outlet of said groundwater chamber and substantially uninterruptedly passing through said wellhead assembly to an opposite end in communication with the above-ground surroundings for collecting a sample quantity of said groundwater from said well; and controller apparatus including means selectively connectable to, and disconnectable from said wellhead assembly in fluid communication with said gas conduit for supplying an actuating gas to said gas chamber of said pump and for alternately pressurizing and relieving the pressure of said actuating gas in said gas chamber in order to cause said bladder to alternately contract and relax to actuate said pump, said controller apparatus further having a diverter valve having an inlet, a first outlet and a second outlet, said inlet of said diverter valve selectively connectable to, and disconnectable from said opposite end of said groundwater conduit and a flow-through cell having an inlet and an outlet, said inlet of said flow-through cell connected to said first outlet of said diverter valve, said flow-through cell further having means for analyzing said groundwater as said groundwater enters said inlet of said cell and leaves said cell through said outlet of said cell.

12. The groundwater sampling apparatus of claim 11 wherein said diverter valve has a poppet valve disposed between said inlet and said first and second outlets, said poppet valve operable under a predetermined fluid pressure to connect said inlet of said valve to said first and second outlets of said valve.

13. The groundwater sampling apparatus of claim 11 wherein said second outlet of said diverter valve is connected to a sample collection vessel.

14. The groundwater sampling apparatus of claim 11 wherein said outlet of said flow-through cell is connected to a sample collection vessel.

15. The groundwater sampling apparatus of claim 11 wherein said analyzing means comprises a water analyzer having a plurality of sensors for measuring a plurality of conditions of said groundwater.

16. An apparatus for analyzing a fluid, said apparatus comprising:

a flow-through cell having an inlet and an outlet, said inlet of said flow-through cell selectively connectable to and disconnectable from a source of fluid; and means for analyzing said fluid, said analyzing means operably associated with said flow-through cell such that said fluid within said cell is analyzed between the time said fluid enters said inlet of said cell and leaves through said outlet of said cell.

17. The apparatus of claim 16 further comprising a diverter valve disposed between said flow-through cell and said source of said fluid, said diverter valve having an inlet, a first outlet and a second outlet.

18. The apparatus of claim 17 wherein said diverter valve has a poppet valve disposed between said inlet and said first and second outlets, said poppet valve operable under a predetermined fluid pressure to connect said inlet of said valve to said first and second outlets of said valve.

19. The apparatus of claim 16 wherein said flow-through cell comprises:

an inlet housing, said inlet of said cell being disposed in said inlet housing;

an outlet housing spaced from said inlet housing, said outlet of said cell being disposed in said outlet housing; and a cylinder disposed between said inlet housing and said outlet housing, said cylinder defining a chamber between said inlet and outlet housings;

said outlet housing being adapted to sealing mount said analyzing means within said chamber defined by said cylinder.

20. The apparatus of claim 19 wherein said cylinder is made from a clear material such that it is possible to see said fluid as said fluid moves through said flow-through cell.

21. The groundwater sampling apparatus of claim 19 wherein said flow-through cell further comprises a diffuser plate disposed between said inlet and said outlet.

* * * * *

UNITED STATES PATENT AND TRADEMARK OFFICE

CERTIFICATE OF CORRECTION

PATENT NO. : 5,261,348

DATED : November 16, 1993

INVENTOR(S) : K. Lynn Niehaus et al.

It is certified that error appears in the above-indentified patent and that said Letters Patent is hereby corrected as shown below:

ON THE TITLE PAGE, Abstract, line 7
"flow" should be --flowing--.

Column 1, line 8
"flow through" should be --flow-through--.

Column 1, line 45
"operate" should be --operates--.

Column 1, line 57
"insure" should be --ensures--.

Column 3, line 46
"popped" should be --poppet--.

Column 4, line 24
"The" should be --This--.

Column 4, line 27
"flow through" should be --flow-through--.

Column 4, line 31
"flow through" should be --flow-through--.

Column 4, line 48
"4,103,179 should be --5,103,179-.

Column 4, line 67
"by" (first occurrence) should be --be--.

UNITED STATES PATENT AND TRADEMARK OFFICE

CERTIFICATE OF CORRECTION

PATENT NO. : 5,261,348

DATED : November 16, 1993

INVENTOR(S) : K. Lynn Niehaus et al.

It is certified that error appears in the above-identified patent and that said Letters Patent is hereby corrected as shown below:

Column 4, line 67
"purge" should be --purged--.

Column 5, line 1
"purge" should be --purged--.

Column 5, line 52, claim 1
"through-cell" should be --flow-through cell--.

Column 6, line 36, claim 6
"through-cell" should be --flow-through cell--.

Column 6, line 40, claim 6
"cell;" should be --cell.--.

Signed and Sealed this

Twenty-seventh Day of September, 1994

*Attest:*

Bruce Lehman

BRUCE LEHMAN

*Attesting Officer*

*Commissioner of Patents and Trademarks*